US010421654B2

(12) United States Patent
Clüsserath et al.

(10) Patent No.: US 10,421,654 B2
(45) Date of Patent: Sep. 24, 2019

(54) FILLING-ELEMENT ASSEMBLY AND FILLING MACHINE

(71) Applicant: KHS GmbH, Dortmund (DE)

(72) Inventors: Ludwig Clüsserath, Bad Kreuznach (DE); Bernd Bruch, Weinsheim (DE); Dieter-Rudolf Krulitsch, Bad Kreuznach (DE)

(73) Assignee: KHS GmbH, Dortmund ( * ) Notice: Subject to any disclaimer, the term of this patent is extended or adjusted under 35 U.S.C. 154(b) by 139 days.

(21) Appl. No.: 15/563,156

(22) PCT Filed: Apr. 19, 2016

(86) PCT No.: PCT/EP2016/058637
§ 371 (c)(1),
(2) Date: Sep. 29, 2017

(87) PCT Pub. No.: WO2016/169925
PCT Pub. Date: Oct. 27, 2016

(65) Prior Publication Data

US 2018/0086618 A1 Mar. 29, 2018

(30) Foreign Application Priority Data

Apr. 21, 2015 (DE) ..... 10 2015 106 125

(51) Int. Cl.
*B67C 3/26* (2006.01)
*B67C 3/04* (2006.01)
*B67C 3/06* (2006.01)

(52) U.S. Cl.
CPC ..... *B67C 3/2637* (2013.01); *B67C 3/04* (2013.01); *B67C 3/06* (2013.01); *B67C 3/2614* (2013.01)

(58) Field of Classification Search
CPC ..... B67C 3/04; B67C 3/26; B67C 3/2614; B67C 3/2637
See application file for complete search history.

(56) References Cited

U.S. PATENT DOCUMENTS 2,574,746 A 11/1951 Luther
3,155,127 A * 11/1964 Hubbard ..... B67C 3/2637 141/245

(Continued)

FOREIGN PATENT DOCUMENTS

DE 10 2008 057752 5/2010
DE 10 2012 014 957 5/2014

(Continued)

*Primary Examiner* — Reinaldo Sanchez-Medina
(74) *Attorney, Agent, or Firm* — Occhiuti & Rohlicek LLP

(57) ABSTRACT

A filling-element assembly for both pressurized and open-jet filling of containers includes a filling element having a filling-element housing, a liquid valve, a return-gas channel, and a seal. The housing has a fixed first segment, a vertically movable second segment, and an extendable segment between them to surrounds the valve housing in a fluid-tight manner. A return-gas channel extends along the filling-element axis between the valve housing and the filling-element housing. In a raised position of the second segment, the seal contacts the valve housing along a circumferential contact area and seals the filling-element discharge opening thereby forming a fluid-tight closure for the return-gas channel.

23 Claims, 9 Drawing Sheets

(56) References Cited

U.S. PATENT DOCUMENTS

| | | | | | |
|---|---|---|---|---|---|
| 3,416,577 | A * | 12/1968 | Franz | B67C 3/2637 | 141/117 |
| 3,799,222 | A * | 3/1974 | Franz | B67C 3/16 | 141/291 |
| 3,848,645 | A * | 11/1974 | Franz | B67C 3/16 | 141/117 |
| 3,871,425 | A * | 3/1975 | Fee | B67C 3/26 | 141/117 |
| 4,250,934 | A * | 2/1981 | Wada | B67C 3/204 | 141/260 |
| 4,269,236 | A * | 5/1981 | Fogg | B67C 3/2637 | 141/293 |
| 8,955,562 | B2 * | 2/2015 | Krulitsch | B67C 3/2637 | 141/146 |
| 2015/0191338 | A1 * | 7/2015 | Krulitsch | B65B 39/001 | 141/129 |
| 2016/0167938 | A1 * | 6/2016 | Bruch | B67C 3/004 | 141/95 |

FOREIGN PATENT DOCUMENTS

| | | | | |
|---|---|---|---|---|
| DE | 10 2013 113 070 | | 3/2015 | |
| EP | 1411023 | A1 * | 4/2004 | B67C 3/04 |
| JP | 2002 370797 | | 12/2002 | |
| JP | 2007062771 | | 3/2007 | |
| WO | WO2014/019642 | | 2/2014 | |

* cited by examiner

FILLING-ELEMENT ASSEMBLY AND FILLING MACHINE

RELATED APPLICATIONS

This is the national stage entry of international application PCT/EP2016/058637, filed on Apr. 19, 2016, which claims the benefit of the Apr. 21, 2015 priority date of German application DE 102015106125.2, the contents of which are herein incorporated by reference.

FIELD OF INVENTION

The present invention relates to filling containers, and in particular to a filling-element assembly for either pressurized or open-jet filling of containers with a liquid filling material.

BACKGROUND

Various configurations of filling-element assemblies and filling machines for the filling of bottles or similar containers, in particular for pressurized, open-jet filling, or both, are already known in various different configurations.

The term "open-jet filling" or "open-jet filling content" refers to a filling method in which the liquid filling-material flows into the container that is to be filled in a free filling-jet or filling-material jet and in which the flow of the filling material remains uninfluenced by guide elements such as deflection screens, swirl bodies, or short or long filling tubes.

In some cases, open-jet filling occurs with the pressure in the container equal to ambient pressure. As a rule, the container does not contact the filling element, and is instead located with its mouth opening at some distance to the filling element. In such cases, gas displaced by the incoming filing material simply flows into the ambient air.

In other cases, the container does come into contact with the filling element. In these cases, a gas channel provides an escape path for displaced gas. Preferably, by way of this gas channel, the gas that is present in the container and displaced by the beverage flowing into the container also escapes into the surrounding environment.

If the open-jet filling takes place under a pressure that deviates from ambient pressure, which can be above or below the ambient pressure, then the container is pressed with its mouth against the filling element and sealed, whereupon the pressure in the interior of the container is then adjusted. The pressure can be adjusted upwards by providing a pressurized gas or downward by connecting the container's interior to a vacuum source.

In an alternative filling method, the liquid filling-material flows into the container under the influence of guide elements, such as deflection screens, torsion bodies, and/or short or long filling tubes. This filling method, too, can take place at ambient pressure or at a pressure that deviates therefrom.

In some cases, the container is sealed against the filling element. This means that the container is located with its container mouth in contact and pressed such as to form a fluid-tight seal against the filling element's discharge opening.

SUMMARY

Gas transfer into or out of a container requires controlled gas paths that are opened and closed by control valves. These control valves are generally parts of a pneumatic valve assembly. It is important that these gas path not be contaminated by microorganisms.

An object of the present invention is to provide a filling-element assembly that is suitable for open-jet filling under ambient pressure as well as under a pressure that deviates from ambient pressure without any structural alterations to the filling element being necessary for switching between the two filling methods while also reducing and which also presents a reduced germ propagation or contamination risk to the return-gas channel in comparison with the prior art.

An aspect of the present invention can be considered that the filling-element housing comprises a first filling-element housing segment that is fixed in place and a second filling-element housing segment that can be moved in relation to the first filling-element housing segment along a filling element axis between a raised position and a lowered position, that a housing wall segment is provided between the first and second filling-element housing segments, which housing wall segment surrounds the valve housing in a gas-tight manner in such a way that the at least one return-gas channel remains along the filling element axis, and is preferably configured so as to be extensible in the longitudinal direction, and that the second filling-element housing segment forms the discharge opening and has at least one seal, wherein the seal forms a tight seal around the discharge opening of the valve housing at least in the raised position.

Accordingly, with pressureless open-jet filling, the second filling-element housing segment can be conveyed or moved into its raised position, and thereby seals the gas paths used and necessary during the pressure filling against the hygiene space or against the surrounding environment, as a result of which no product can pass into this region, and, in particular, the return-gas channel of the filling element is also sealed.

The first filling-element housing segment, arranged fixed in place, can be arranged, for example, at the filling element, at a carrier plate, or also on the underside of the filling material container.

In some embodiments, the second filling-element housing segment comprises a first contact side, facing towards the discharge opening, and a second contact side, facing towards a container mouth. In this situation, provision can preferably be made for the seal to be arranged at least at the first contact side of the second filling-element housing segment. Preferably, the seal arranged at the first contact side can enclose the discharge opening in the raised position, such as to be gas-tight and/or liquid-tight.

In some embodiments, the second contact side can be configured such that, in the lowered position, it accommodates the container mouth in a centered position. Preferably, the seal can be provided on both the first as well as on the second contact side, and/or arranged so as to be in contact surrounding the discharge opening in the sealing position when in the raised position, and in contact in the sealing position with the container mouth when in the lowered position.

For particular preference, the first contact side and/or the second contact side can be formed at least in sections from a sealing material, and form at least one seal.

In this situation, provision can advantageously be made for the seal to be configured as one part or one piece. As an alternative, provision can also be made for the seal to be configured as multi-part, in particular two-part, wherein a first part, in the raised position, is arranged surrounding the discharge opening in a sealing position and a second part, in the lowered position, is in a sealing position with the container mouth.

Preferably, the second filling-element housing segment comprises on its outside an at least partially radially circumferential cut-out opening. Advantageously, in this situation a connecting piece can be accommodated in positive fit in the cut-out opening, arranged secured to a lifting rod, such that, by means of the connecting piece, a mechanical forced guide arrangement can be established between the lifting rod and the second filling-element housing segment.

Again advantageously, the second filling-element housing segment can be configured as a conical ring-shaped body with a V-shaped cross-section. The second filling-element housing segment can comprise, in the transition region between the first and second contact side, a circumferential seal in the form of a collar, which, in the lowered position, projects with its free circumferential face side from above into the container mouth.

In an advantageous embodiment variant, the valve housing can comprise, in the region of the discharge opening, a tubular valve-housing extension. Preferably, provision can be made for the second filling-element housing segment to comprise at least one penetration aperture penetrating fully through the first and second contact sides.

According to a further embodiment variant, the second filling-element housing segment can comprise on its underside, pointing towards the container mouth, a circumferential seal in the form of beading. Advantageously, the rotatable housing segment can be configured as a folding bellows element and/or roll membrane.

In a further advantageous variant embodiment, the housing wall section can be connected both to the first filling-element housing segment as well as to the second filling-element housing segment such as to be gas-tight and/or liquid-tight. The filling-element housing can in this situation also be configured as being of one part.

According to a further embodiment variant, at least one container carrier can be provided, to accommodate at least one container. In this situation, provision can be made for the at least one container carrier is provided on a guide rod which is rotationally movable, in particular pivotable. In one advantageous embodiment variant, at least one flushing cap can be provided on the guide rod.

The expressions "essentially" or "about" or "approx." in the meaning of the invention signify deviations from the exact value in each case by +/−10%, preferably by +/−5%, and/or deviations in the form of changes which are not of significance for the function.

Further embodiments, advantages, and possible applications of the invention can also be derived from the following description of exemplary embodiments and from the figures. In this situation, all the features described and/or represented as illustrations are in principle, alone or in combination, objects of the invention, regardless of their combination in the claims or reference to them. The content of the claims is also a constituent part of the description.

BRIEF DESCRIPTION OF THE DRAWINGS

These and other features of the invention will be apparent from the accompanying figures, in which.

For elements of the invention that are the same or have the same effect, identical reference numbers are used in the figures. Moreover, only those reference numbers that are useful for the description of a figure are shown in that figure.

DETAILED DESCRIPTION

Figure 1:
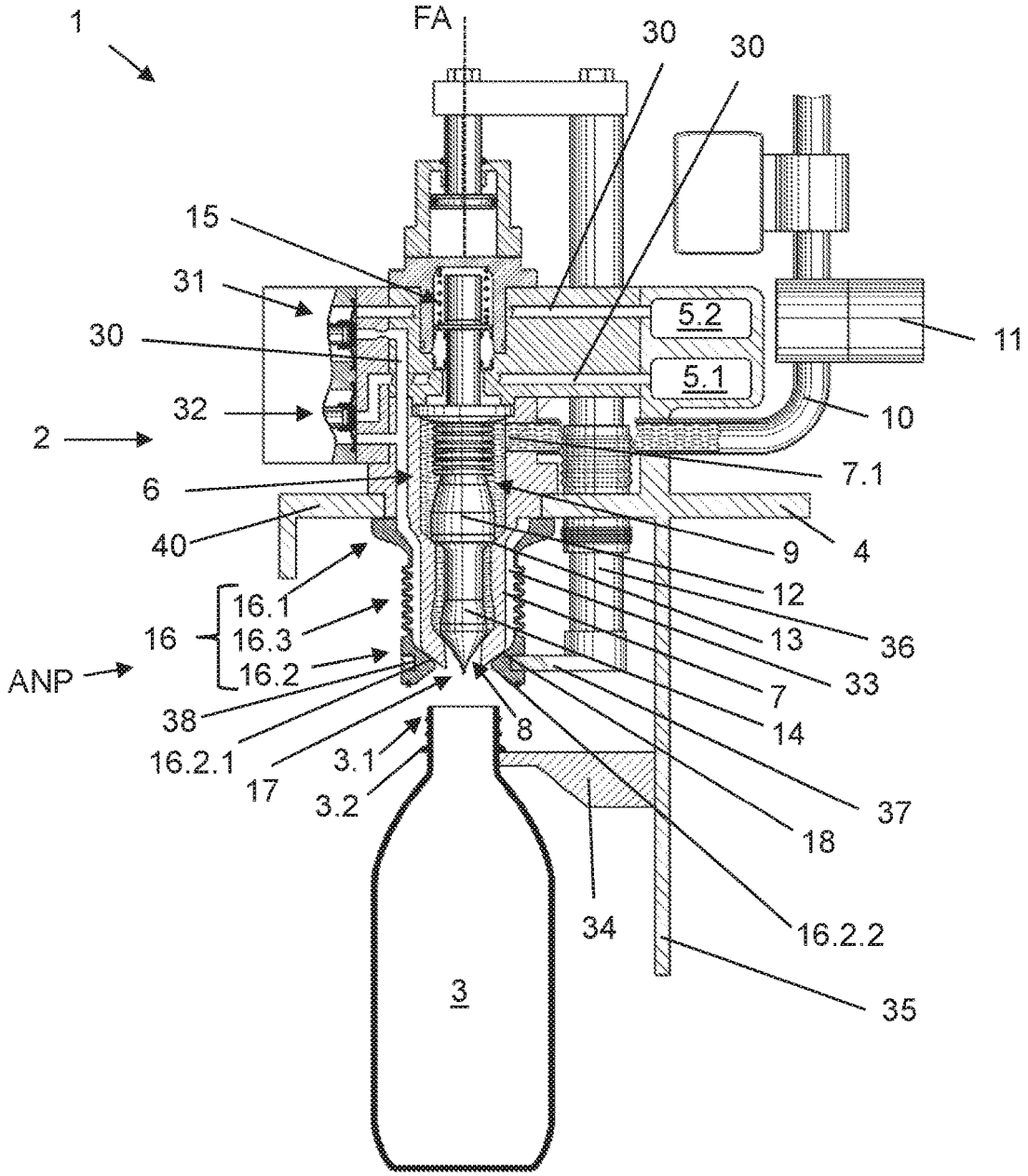
FIGS. 1 and 2 shows sectional views of one embodiment of a filling-element assembly in raised and lowered positions.

FIGS. 1-9 show a filling-element assembly 1 with a filling element 2 for filling containers 3 with liquid filling-material. In the figures, the containers are bottles. The exemplary embodiments represented relate to a rotary filling-machine. However, the apparatus described herein can be used with other filling machines. In particular, the apparatus described herein can be used for row filling and linear filling.

The filling-element assembly 1 is one of several identical filling-element assemblies that are spaced at equal angular distances around the circumference of a rotor 4 that is driven to rotate about a vertical machine-axis. Such a filling machine is a rotary filling-machine.

A filling-material tank on the rotor 4 supplies filling material to all of the filling-element assemblies 1. A suitable filling-material tank is a ring-shaped tank. During the filling operation, an gas space and a liquid space exist in the tank. If the filling-element assembly 1 is being used for the pressurized filling, then pressurized gas fills this gas space. Examples of a suitable pressurized gas include an inert gas and carbon dioxide maintained at the filling pressure.

The filling-element assembly 1 also connects to first and second ring channels 5.1, 5.2 that are common to all the filling element assemblies 1. As an alternative, the filling material and/or the process gases can also be conveyed directly to or away from the filling elements 2 via a rotary distributor.

The filling element 2 includes a liquid valve 6 with a valve housing 7 that has a filling-element discharge-opening 8. A liquid channel 9 formed through the valve housing 7 permits flow of liquid filling-material during filling. An upper region of the liquid channel 9 connects to the common tank via a control valve 11.

The product line 10 opens into the liquid channel 9 via an inlet opening 7.1 provided in the valve housing 7. The axis of the inlet opening 7.1 is oriented horizontally or essentially horizontally, i.e. perpendicular to a filling element axis FA. As a result, liquid filling-material enters the liquid channel 9 with a flow direction that is radially outward relative to the vertical machine-axis.

The filling element 2 also includes a valve body 12 in the liquid channel 9 and a valve seat 13. The valve body 12 and the valve seat 13 interact to open and close the liquid valve 6.

FIG. 1 shows the valve body 12 in a position that closes the liquid valve 6. To open the liquid valve 6, the valve body 12 moves upwards in the direction of the vertical filling-element axis FA out of the position represented in FIG. 1 and into the position shown in FIG. 2.

A valve tappet 14 extends from the valve body 12 coaxially with the filling element axis FA. A sealed upper end of the valve tappet 14 extends out of the liquid channel 9 and interacts with an actuator 15 that is arranged to open and close the liquid valve 6 in a controlled manner.

The filling element 2 further comprises a filling-element housing 16 that comprises first and second housing segments 16.1, 16.2. The first housing segment 16.1 is fixed in place. The second housing segment 16.2 moves in relation to the first housing segment 16.1 along the filling element axis FA between a raised position ANP, shown in FIG. 1, and a lowered position ABP shown in FIG. 2. In some embodiments, the entire filling-element housing 16 is produced as one unitary body, for example by injection-molding.

Between the first and second housing segments 16.1, 16.2, an extendable segment 16.3 of the housing's wall surrounds the valve housing 7 in a fluid-tight manner. This defines an annular return-gas channel 33 along the filling element axis FA between housing's outer wall and the extendable segment's inner wall.

Embodiments of the fluid-tight extendable segment 16.3 are those in which it is configured as a folding bellows and those in which it is configured as a roll membrane. The extendable segment 16.3 is therefore a flexible component. In some cases, it is an elastically deformable component. One way to ensure a fluid-tight extendable segment 16.3 is to use an adhesive to bond the extendable segment 16.3 to both the first and second housing segments 16.1, 16.2.

The second housing segment 16.2 comprises a valve-housing discharge-opening 17 that discharges liquid filling-material into the container 3 and also a seal 18. The filling-element discharge opening 8 faces the valve-housing discharge opening 17. In the raised position ANP, shown in FIG. 1, the seal 18 contacts and seals the filling-element discharge-opening 8.

In the illustrated embodiment, the second housing segment 16.2 comprises the seal 18.

The seal 18 is disposed on a first contact side 16.2.1 that faces the filling-element discharge-opening 8 and radially surrounds the filling-element discharge-opening 8. In so doing, it seals both the filling-element discharge-opening 8 and the return-gas channel 33 in the raised position ANP. It does so without projecting into the liquid jet flowing through the filling-element discharge-opening 8 during the filling process or protruding into it.

As an alternative, it is also possible for the first contact side 16.2.1 to itself form the seal 18. This can be achieved by forming the first contact side 16.2.1 in sections from a sealing material, such as a rubber-like material.

In some embodiments in which the first contact side 16.2.1 forms the seal 18, the second housing segment 16.2 is a ring body with a V-shaped cross-section in sectional side view that forms the valve-housing discharge-opening 17. The seal 18 can therefore be formed both on the first contact side 16.2.1 facing the filling-element discharge-opening 8 or on a second contact side 16.2.2 facing the container mouth 3.2. In either case, the seal 18 is conical.

Accordingly, when the ring body is in its raised position ANP, its first contact-side 16.2.1 makes contact around the filling-element discharge-opening 8 and forms a seal that seals at least the return-gas channel 33. When the ring body is in its lowered position ABP, its second contact side 16.2.2 accommodates and centers the container mouth 3.2. In doing so, it opens the return-gas channel 33 for free flow.

In some embodiments, the seal 18 seals the filling-element discharge-opening 8 when it is in the raised position ANP and seals the container mouth 3.1 when it is in the lowered position ABP.

In some embodiments, the second contact side 16.2.2 forms the seal 18. This can be achieved by forming sections of the second contact side 16.2.2 from a sealing material, such as a rubber-type material. In some embodiments, the seal 18 thus formed is a one-piece seal that is arranged to surround the second housing segment 16.2, which extends circumferentially on one of the first ad second contact sides 16.2.1, 16.2.2.

As an alternative it is also possible for the seal 18 to be a multi-part seal. In a particular embodiment, the seal 18 is a two-part seal having a first seal-part and a second seal-part. In the raised position, the first seal-part seals the filling-element discharge-opening 8. In the lowered position ABP, the second seal-part seals the container mouth 3.1.

In some embodiments, the outside of the second housing segment 16.2 comprises a circumferential cut-out opening 38 into which a connecting piece 37 engages to form a positive fit. The connecting piece 37 is mechanically fixed to a vertically-movable lifting rod 36 that extends along a line parallel to the filling element axis FA. An actuator 39, such as a pneumatic-cylinder assembly, causes such movement.

As a result of the guidance provided by the connecting piece 37 between the second housing segment 16.2 and the lifting rod 36, it is possible, due to a regulated and/or controlled lowering movement initiated onto the lifting rod 36, for the second housing segment 16.2 to be moved vertically along the filling element axis FA between a raised position ANP into a lowered position ABP.

The first housing segment 16.1 is fixed to the filling element 2 in any of a variety of ways. A particularly useful method is to use adhesive bonding. In some embodiments, the first housing segment 16.1 connects to a filling element carrier 40 that, in turn, connects the filling element 2 to the rotor 4.

The filling element 2 further includes controlled gas channels 30 and first and second control valves 31, 32 that control flow through the gas channels. Opening the first control valve 31 creates a flow path between the return-gas channel 33 and the second ring channel 5.2 to provide pressure relief. Opening the second control valve 32 connects the return-gas channel 33 to the first ring channel 5.1 to provide a source of positive pressure.

Figure 6:
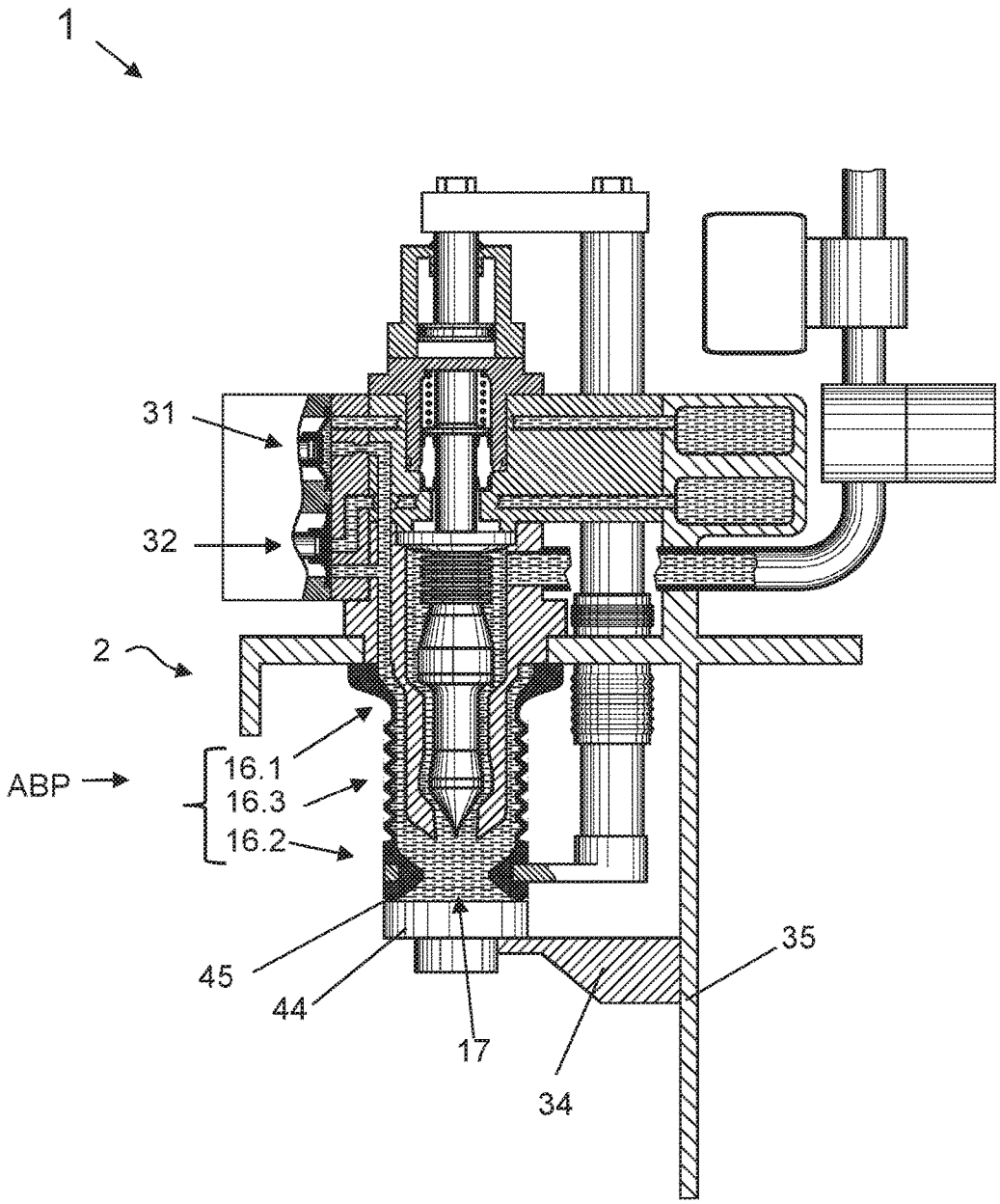
FIG. 6 is a sectional view of a filling-element assembly capped with a flushing cap
Figure 7:
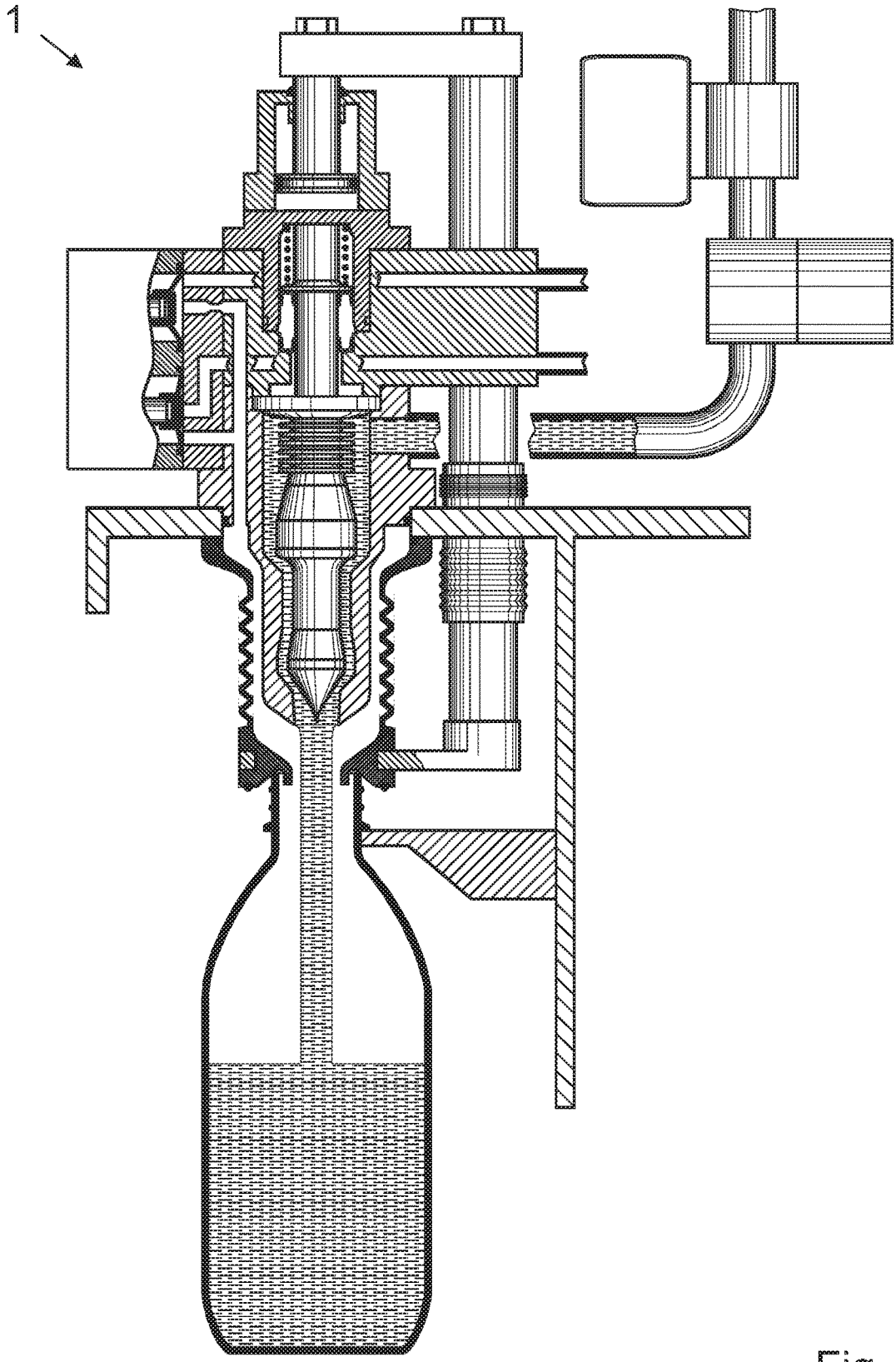
FIG. 7 is a sectional view showing a fixed filling-element housing segment arranged on a retaining plate or base plate
Figure 8:
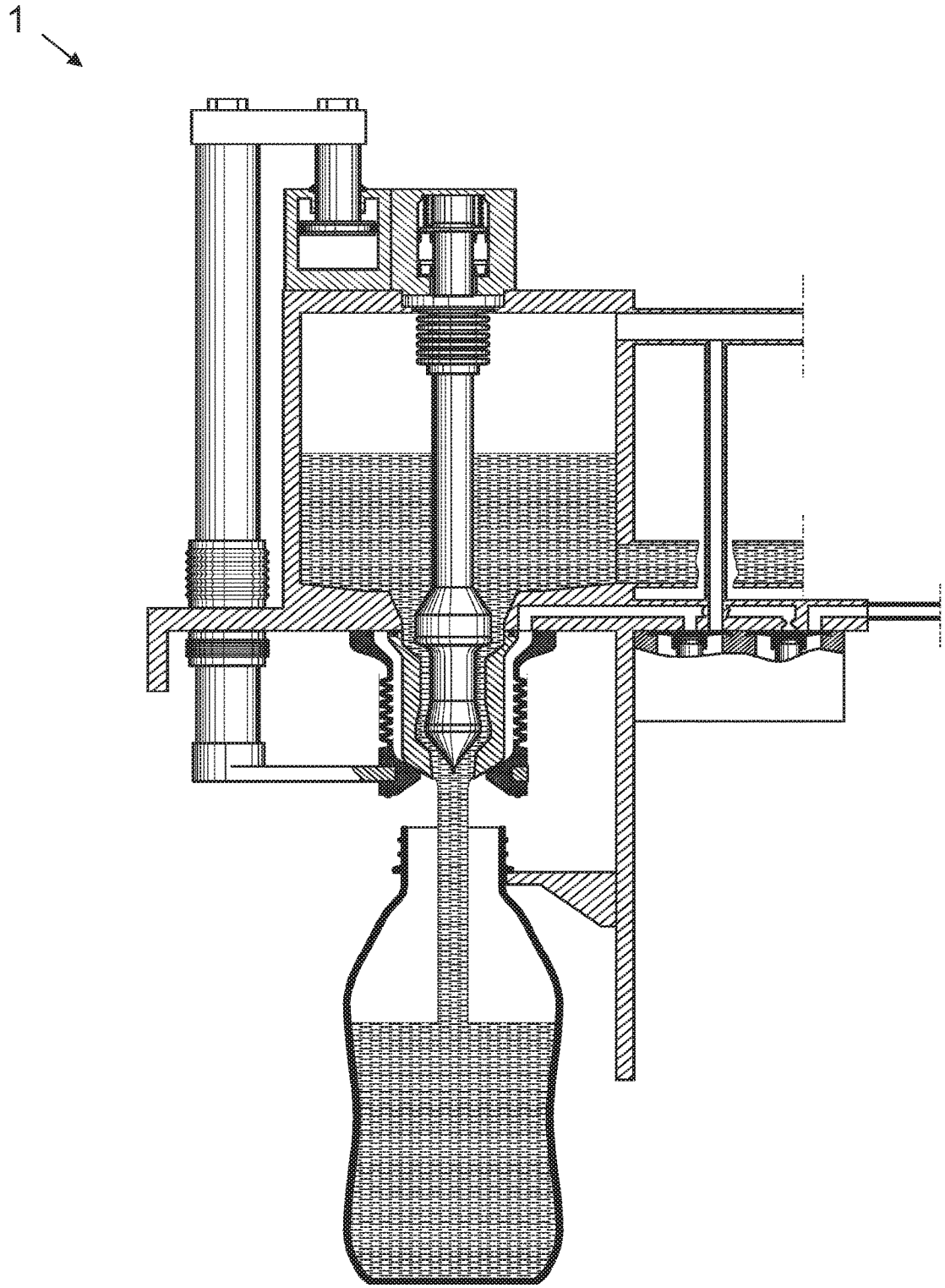
FIG. 8 is a sectional view of an embodiment in which the first filling-element housing segment is fixed in place on the underside of a filling material container
Figure 9:
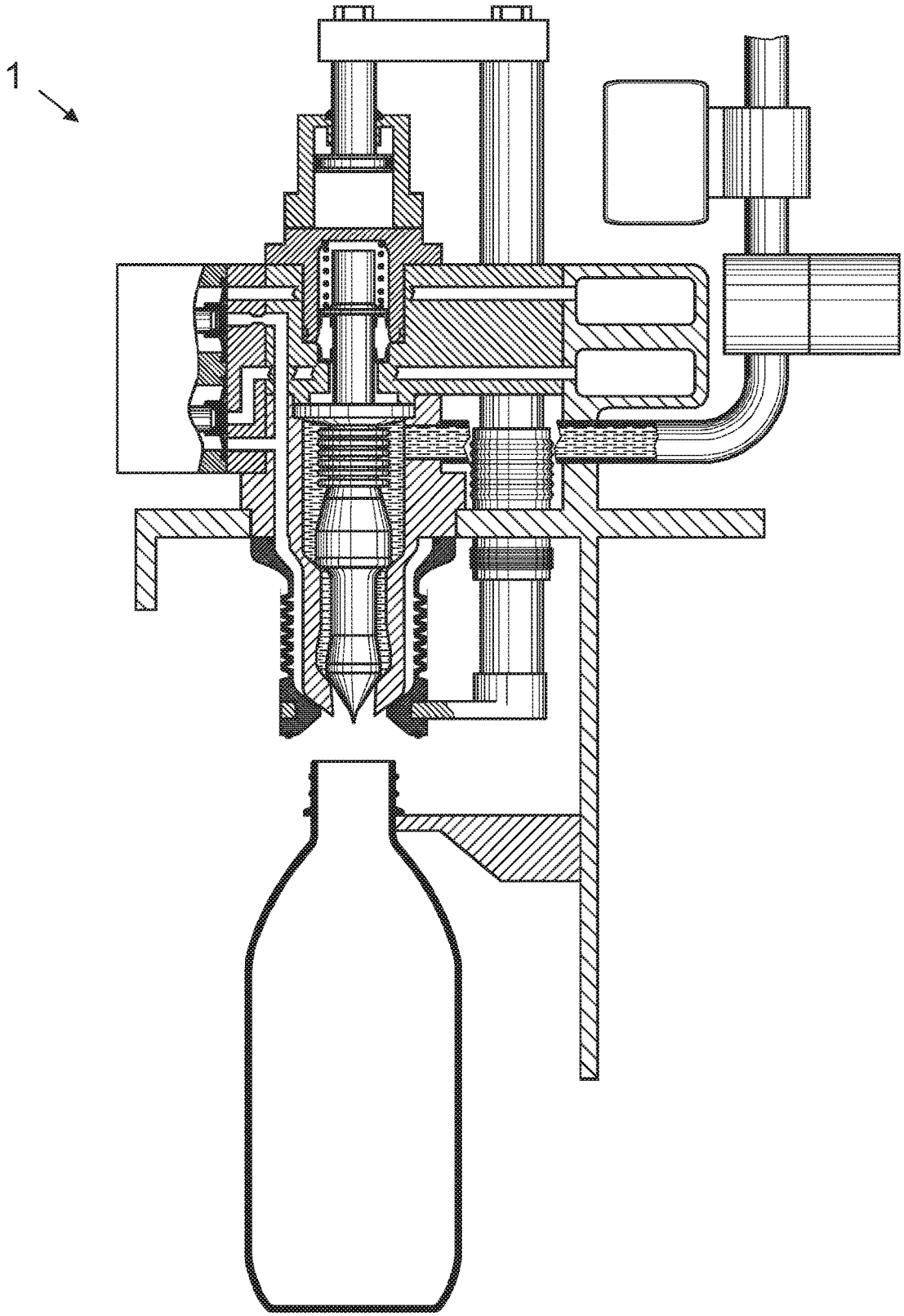
FIG. 9 is a sectional view of an embodiment in which the first filling-element housing segment is arranged fixed in place completely at the valve housing.

The controlled gas channels 30 and the first and second control valves 31, 32 also participate in an intensive CIP cleaning and/or sterilization of the filling elements 2 as shown in FIG. 6. In this configuration, a flushing cap 44 closes off the filling element's discharge-opening 8 and both the liquid valve 6 and the control valve 11 open.

Open-jet filling includes closing the first and second control valves 31, 32, and raising the second housing segment 16.2 into the raised position ANP, and holding the container 3 that is to be filled coaxially with the filling element axis FA and with its container mouth 2.1 at a distance below the valve-housing discharge-opening 17.

Typically, a container carrier 34, which can be configured as a neck-ring holder, holds the container 3 by suspending it from its mouth flange 2.2. In some embodiments, container holder 34 is configured to accommodate a particular mouth diameter. In other embodiments, the container carrier 34 is adjustable to accommodate many different mouth diameters.

In the embodiment shown in FIG. 1, a guide rod 35 holds the container carrier 14. The guide rod 35 is pivotable so that it can swing a container 3 towards and away from a filling position in which it is coaxial with the filling-element axis FA.

As an alternative, it is also possible to allocate container carriers 34 to the guide rod 35. In some embodiments, these container carriers 34 are of different sizes. The container carriers 34 are all pivotable around the guide rod 35 so that any one of them can be pivoted under the filling element 2 in a controlled manner.

In some embodiments, the flushing cap 44 is also allocated to the guide rod so that it cab be pivoted into and out of position by the guide rod 35, as shown in FIG. 6.

Figure 2:
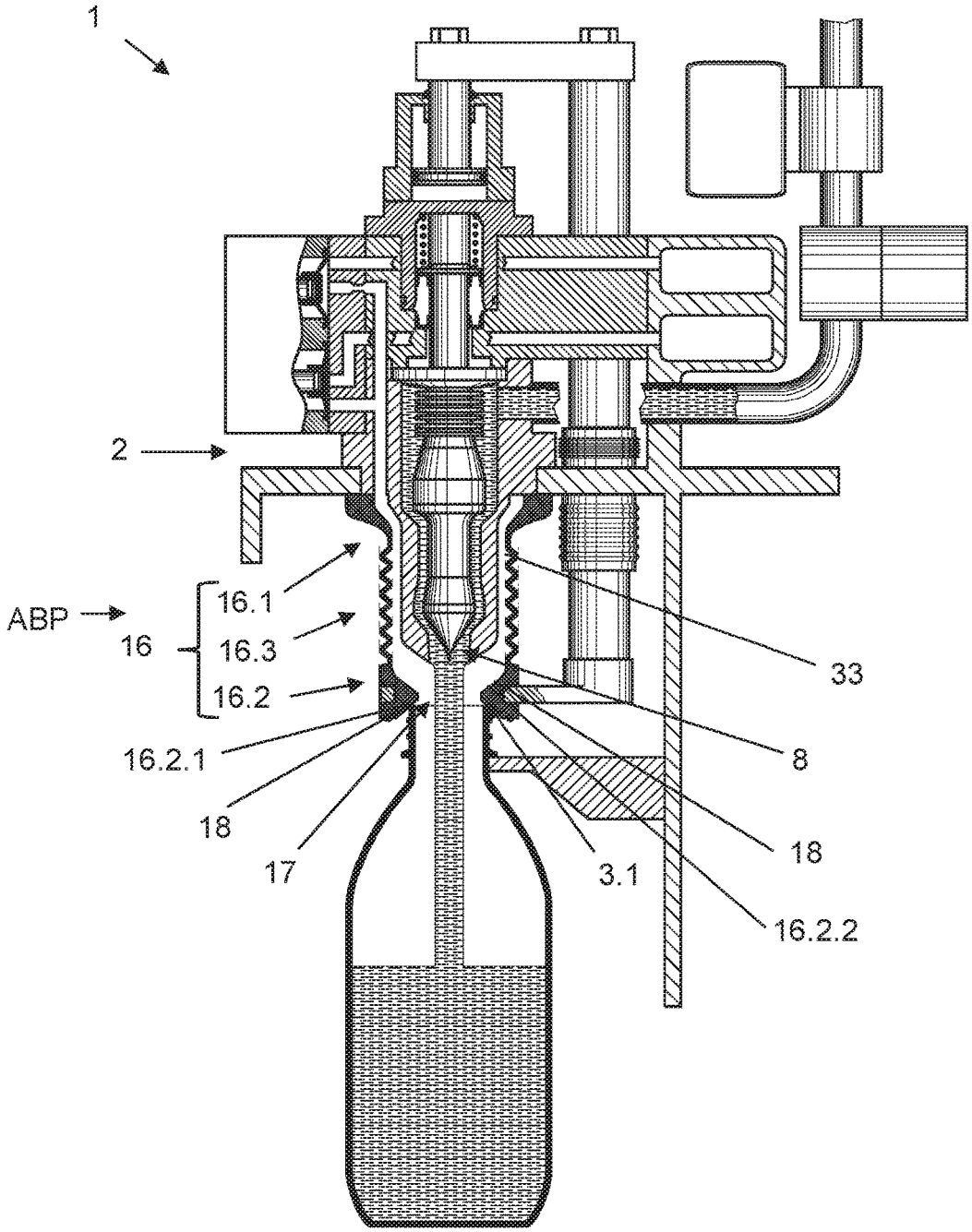

FIG. 2 shows the filling element being used for pressurized filling. During pressurized filling, the second housing segment 16.2 moves into its lowered position ABP and seals against the container mouth 3.1. On moving down into its lowered position ABP, and before it seals itself against the container mouth 3.1, the second housing segment 16.2, which in this embodiment is configured as a cone, centers the container mouth 3.1 using its second contact side 16.2.2. When the second housing segment is in its lowered position ABP, the return-gas channel 33 is open and creates a controlled gas channel 30.

Before liquid enters the container, the second control valve 32 opens, thus creating a gas channel between the container and the second ring channel 5.2. Pressurized inert gas thus flows from the second ring channel 5.2 into the container 3. This results in a preliminary pressurizing step for the container 3.

Next comes a rapid filling phase that begins with opening the liquid valve 6 and opening the first control valve 31 to create a controlled gas channel 30 between the container 3 and the first ring channel 5.1. As filling material flows through the liquid valve 6 into the container 3, it displaces the gas in the container 3. This gas escapes through the return-gas channel 33, then through the controlled gas channel 30, and finally into the first ring channel 5.1, which is a pressure-relief channel.

Figure 3:
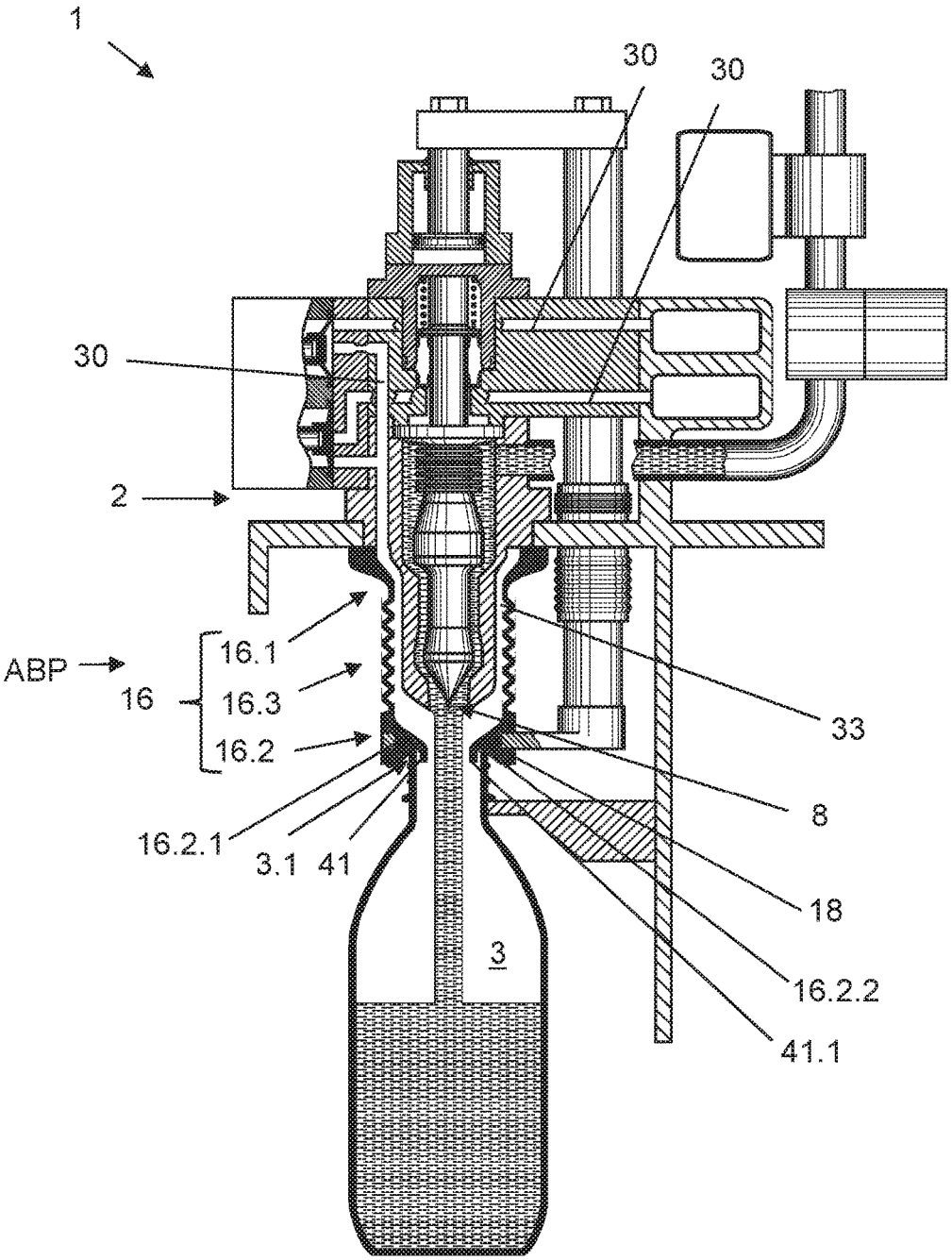
FIG. 3 shows a sectional view of another embodiment of a filling-element assembly in its lowered position.

In an alternative embodiment, shown in FIG. 3, the second housing segment 16.2 comprises a further seal 41 that is arranged in the transition region between the first and second contact sides 16.2.1, 16.2.2. The further seal 41 extends circumferentially to form a collar that functions as a sealing lip.

In this embodiment, in the lowered position ABP, a circulating free face side 41.1 of the further seal 41 descends from above and engages the container mouth 3.1. In doing so, it prevents a deflection of the filling jet caused by centrifugal force from wetting the container mouth 3.1 with filling material.

In some embodiments, the further seal 41 is configured as one piece with the second housing segment 16.2. In other embodiments, the further seal 41 is attached to the second housing segment at it, for example by having been secured with adhesive.

In order to prevent a wetting of the container mouth 3.1 during pressureless filling as well as during pressurized filling, it is possible to carry out pressureless filling with the second housing segment 16.2 also having been moved into its lowered position ABP. The return gas that emerges from the container 3 during filling can then be carried away using the same gas path 30 that was used in the case of pressurized filling.

As an alternative, it is also possible for a pressureless fine jet filling to be carried out with the second housing segment 16.2 in it raised position ANP. Doing so will block the gas channel 30 and the return-gas channel 33 and thereby prevent any outside gases from penetrating into the container 3.

Figure 4:
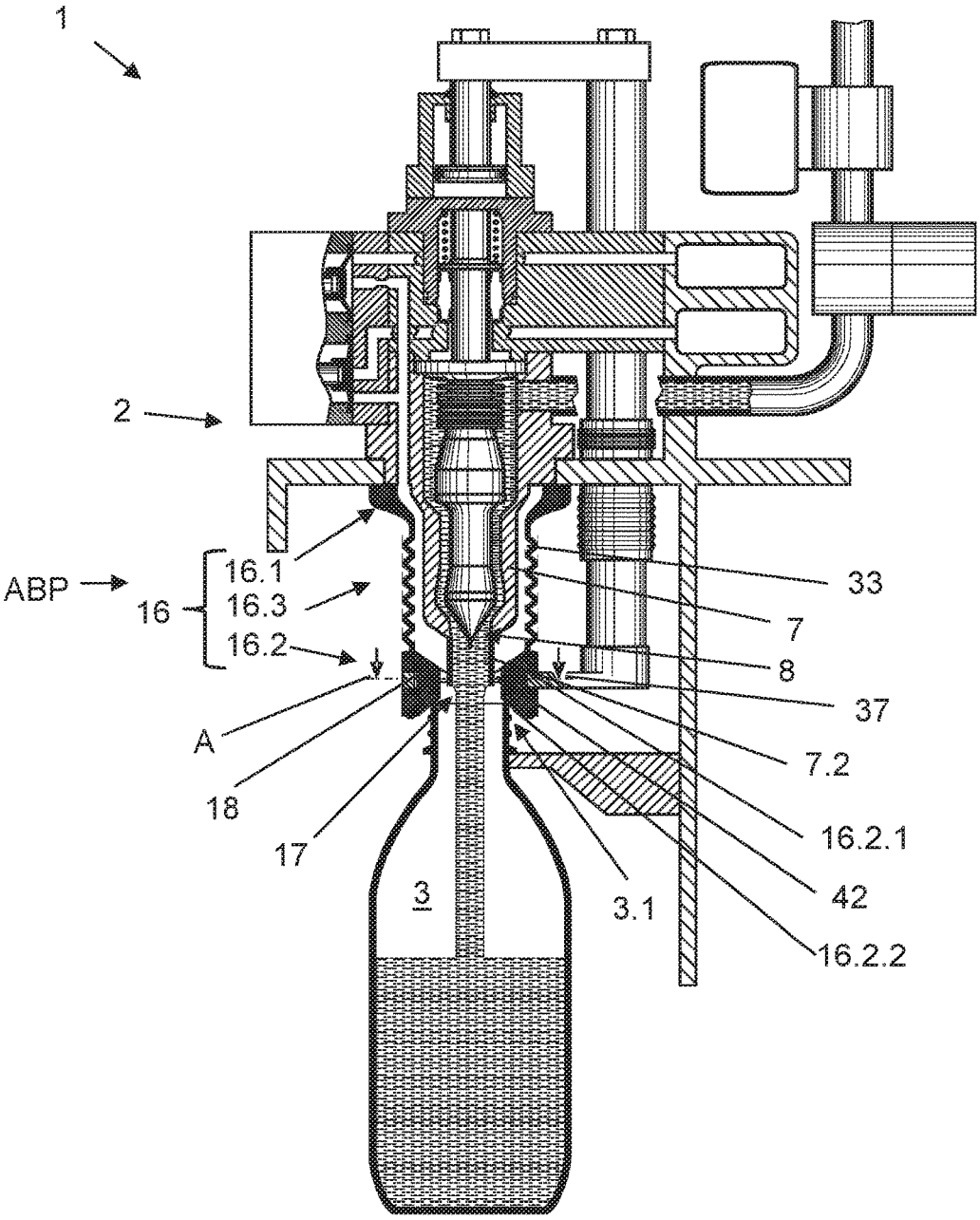
FIG. 4 shows a sectional view of another embodiment of a filling-element assembly in its lowered position.

FIG. 4 shows a further embodiment in which the valve housing 7 comprises, in the region of the filling-element discharge-opening 8, a ring-shaped valve-housing extension 7.2. In some embodiments, the valve-housing extension 7.2 is cylindrical and extends in a direction concentric with the filling element axis FA in the direction of the second housing segment 16.2. The longitudinal extension along the filling element axis FA of the valve-housing extension 7.2 is selected in such a way that when the second housing segment 16.2 is in its lowered position ABP, it still surrounds the valve-housing extension 7.2 and forms a positive fit. As a result, the valve-housing extension 7.2 permits a mechanical forced guidance of the second housing segment 16.2 during its vertical movement. This improves centering of the container 3 by the second contact side 16.2.2.

To achieve a gas exchange for pressurized filling, between the container 3 and the filling element 2, the second housing segment 16.2 comprises at least one penetration aperture 42 that penetrates fully through the first and second contact sides 16.2.1, 16.2.2. This penetration aperture 42 permits gas exchange between the container 3 and the filling element 2, via the return-gas channel 33. A suitable penetration aperture 42 is a bore hole.

Figure 5:
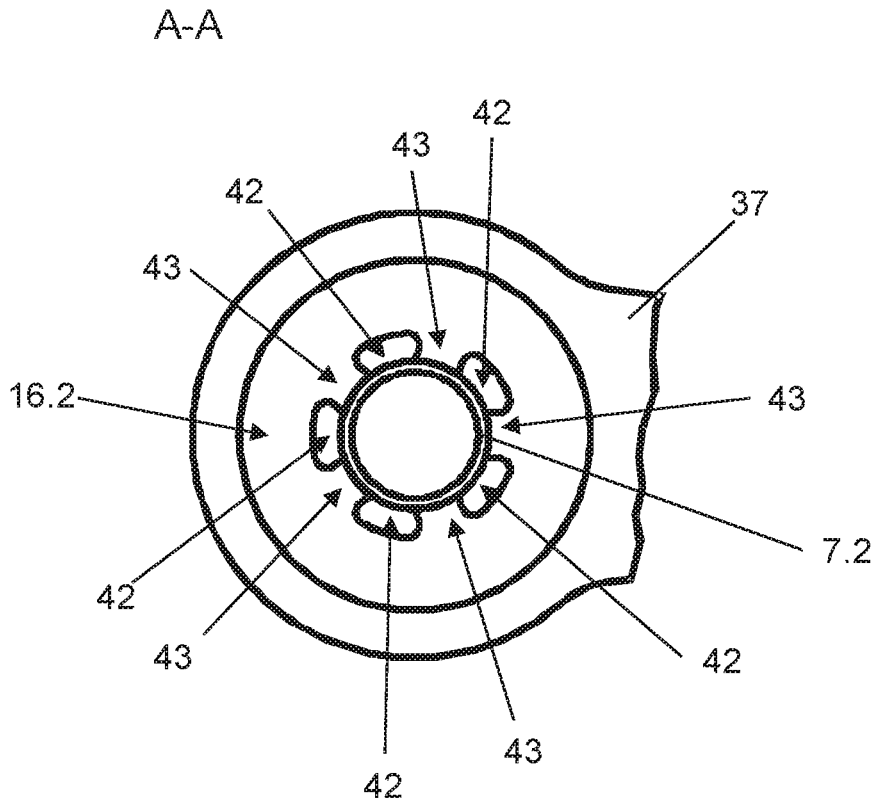
FIG. 5 is a cross-section of a filling-element housing segment from the embodiment shown in FIG. 4.

FIG. 5 shows a sectional view of the second housing segment 16.2 of the embodiment shown in FIG. 4. As shown in FIG. 4, the second housing segment 16.2 comprises a plurality of penetration apertures 42 that are arranged circumferentially around the valve-housing extension 7.2, preferably at equal angular distances. In some embodiments, the penetration apertures 42 extend as far as the outer wall of the valve-housing extension 7.2.

The penetration apertures 42 define webs 43 therebetween. These webs 43 extend to the outer wall of the valve-housing extension 7.2 and thereby ensure mechanical forced guidance of the second housing segment's vertical movement at the valve-housing extension 7.2.

FIG. 6 shows a yet another embodiment of a filling-element assembly 1 in which the second housing-segment 16.2 has an underside that faces a flushing cap 44. In this embodiment, the underside features a sealing bead 45 that runs circumferentially around the valve-housing discharge-opening 17. In some embodiments, the sealing bead 45 is a shaft seal. In others, the sealing bead 45 is a sealing lip. In either case, the sealing bead 45 permits the second housing-segment 16.2 to be sealed against the flushing cap 44 in the lowered position ABP for a CIP cleaning and/or sterilization.

In some embodiments, the flushing cap 44 is arranged at the container carrier 34. For CIP cleaning and/or sterilization, it is also possible for a CIP return line to be allocated to the flushing cap 44 to carry away cleaning agent and/or flushing gas. The actual CIP cleaning and/or sterilization. The CIP cleaning procedure is carried out in a manner similar to the filling procedure using the first and second control valves 31, 32.

The invention has been described heretofore by way of a number of exemplary embodiments. It is understood that numerous modifications and changes to the invention are possible, without thereby departing from the inventive concept.

The invention claimed is:

1. An apparatus comprising a filling-element assembly for both pressurized and open-jet filling of a container with liquid filling-material, said container having a mouth, said filling-element assembly comprising a filling element, said filling element comprising a filling-element housing, a liquid valve, a return-gas channel, and a seal, wherein said filling-element housing comprises a housing discharge-opening, a first housing-segment, a second housing-segment, and an extendable housing-segment, wherein said liquid valve comprises a valve housing, a valve body, a liquid channel, and a filling-element discharge-opening, wherein said housing discharge-opening discharges said liquid filling-material into said container, wherein said first housing-segment is fixed in place, wherein said second housing-segment is movable along a filling-element axis between a raised position and a lowered position, wherein said second housing-segment forms said housing discharge-opening, wherein said extendable segment is disposed between said first housing-segment and said second housing-segment, and wherein said extendable segment surrounds said valve housing in a fluid-tight manner, wherein said valve body moves within said valve housing between open and closed positions to control discharge of said liquid filling-material, wherein said filling-element discharge-opening faces said housing discharge-opening, and wherein liquid filling-material flows through said liquid channel during filling, wherein said return-gas channel extends along said filling-element axis and is formed between said valve housing and said filling-element housing, and wherein, in said raised position, said seal contacts said valve housing along a circumferential contact area and seals said filling-element discharge opening thereby forming a fluid-tight closure for said return-gas channel.

2. The apparatus of claim 1, further comprising a container carrier, wherein said container carrier is configured to receive at least one container.

3. The apparatus of claim 1, further comprising a bead seal, wherein said bead seal extends in a circumferential direction, wherein said bead seal is disposed on an underside of said second housing-segment facing said mouth.

4. The apparatus of claim 1, wherein said second housing-segment has a first contact-side and a second contact-side, wherein said first contact-side faces said filling-element discharge-opening, wherein said second contact-side faces said mouth, wherein said seal is provided at said first and second contact sides, wherein said seal is arranged such that when said second housing-segment is in said raised position, said seal seals said filling-element discharge-opening and wherein when said second housing-segment is in said lowered position, said seal seals said mouth.

5. The apparatus of claim 1, wherein said second housing-segment has a first contact-side and a second contact-side, wherein said first contact-side faces said filling-element discharge-opening, wherein said second contact-side faces said mouth, and wherein, when said second housing-segment is in said lowered position, said second contact-side receives said mouth and centers said container such that said container is coaxial with said filling element axis.

6. The apparatus of claim 1, wherein said second housing-segment comprises a cut-out opening formed on an outside thereof, wherein said cut-out opening extends in a circumferential direction.

7. The apparatus of claim 1, further comprising a lifting rod and a connection piece, wherein said connection piece is secured to said lifting rod, wherein said connection piece forms a positive fit when accommodated in a circumferential cut-out opening formed on an outside of said second housing-segment, and wherein said positive fit permits movement of said lifting rod to mechanically guide movement of said second housing-segment.

8. The apparatus of claim 1, wherein said extendable housing-segment comprises one of a folding bellows and a roll membrane.

9. The apparatus of claim 1, wherein, when said second housing-segment is in said raised position, said seal surrounds said filling-element discharge-opening and forms a fluid-tight seal at said filling-element discharge-opening.

10. The apparatus of claim 1, further comprising a rotor that is driven to rotate about a vertical machine axis, wherein said filling-element assembly is one of a plurality of filling-element assemblies on a circumference of said rotor.

11. The apparatus of claim 1, wherein said second housing-segment comprises a first contact-region, a second contact-region, and circumferential seal in a transition region between said first and second contact-regions, wherein said circumferential seal defines a collar, wherein said collar projects with a freely-circulating front side thereof from above and into said mouth when said second housing-segment is in said lowered position.

12. The apparatus of claim 1, wherein said second housing-segment comprises a first contact-side and a second contact-side, wherein said first contact-side faces said filling-element discharge-opening, and wherein said second contact-side faces said mouth.

13. The apparatus of claim 1, wherein said valve housing comprises a tubular valve-housing extension in a region of said filling-element discharge-opening.

14. The apparatus of claim 1, wherein said seal comprises a first part and a second part, wherein when said second housing-segment is in said raised position, said first part seals said filling-element discharge opening, and wherein when said second housing-segment is in said lowered position, said second part seals said mouth.

15. The apparatus of claim 1, further comprising a guide rod that is pivotable and a container carrier coupled to said guide rod.

16. The apparatus of claim 1, wherein said filling-element housing is a one-part housing.

17. The apparatus of claim 1, wherein said second housing-segment comprises a penetration aperture that penetrates through first and second contact-sides of said second housing-segment.

18. The apparatus of claim 1, wherein said seal is formed as a single unitary structure.

19. The apparatus of claim 1, further comprising a flushing cap, said flushing cap being disposed on a pivotable guide rod.

20. The apparatus of claim 1, wherein said seal is arranged on a first contact-side of said second housing-segment, said first contact-side facing said filling-element discharge opening.

21. The apparatus of claim 1, wherein said second housing-segment comprises a conical ring body having a V-shaped cross-section.

22. The apparatus of claim 1, further comprising first and second fluid-tight connections, wherein said first fluid-tight connection is between said extendable housing-segment and said first housing-segment, and wherein said second fluid-tight connection is between said extendable housing-segment and said second housing-segment.

23. The apparatus of claim 1, wherein at least one of a first and second contact-side of said second housing-segment forms said seal from a plurality of sealing-material sections, wherein said plurality of sealing-material sections faces at least one of said filling-element discharge-opening and said second contact-side faces said mouth.

* * * * *